US008366916B2

(12) United States Patent
Lee

(10) Patent No.: US 8,366,916 B2
(45) Date of Patent: Feb. 5, 2013

(54) MAGNETIC NANOPARTICLE COMPLEX

(75) Inventor: Jin-Kyu Lee, Seoul (KR)

(73) Assignee: Seoul National University Research & Development Business Foundation ("SNU R&DB Foundation"), Seoul (KR)

( * ) Notice: Subject to any disclaimer, the term of this patent is extended or adjusted under 35 U.S.C. 154(b) by 0 days.

(21) Appl. No.: 13/404,517

(22) Filed: Feb. 24, 2012

(65) Prior Publication Data

US 2012/0145601 A1 Jun. 14, 2012

Related U.S. Application Data

(62) Division of application No. 12/199,358, filed on Aug. 27, 2008, now Pat. No. 8,157,986.

(51) Int. Cl.

| | |
|---|---|
| ***C10G 32/02*** | (2006.01) |
| ***C07F 15/02*** | (2006.01) |
| ***B82Y 40/00*** | (2011.01) |
| ***B82Y 25/00*** | (2011.01) |

(52) U.S. Cl. ..... 208/263; 556/146; 977/896; 977/902; 977/838; 502/200

(58) Field of Classification Search ..... None
See application file for complete search history.

(56) References Cited

U.S. PATENT DOCUMENTS

| | | | |
|---|---|---|---|
| 4,199,440 | A | 4/1980 | Verachtert |
| 5,182,013 | A | 1/1993 | Petersen et al. |
| 6,121,411 | A | 9/2000 | Sartori et al. |
| 6,627,069 | B2 | 9/2003 | Greaney |
| 2006/0240489 | A1 | 10/2006 | Wei et al. |

FOREIGN PATENT DOCUMENTS

| | | |
|---|---|---|
| EP | 2 063 433 | 5/2009 |
| JP | 09-183763 | 7/1997 |
| KR | 1020050033249 | 4/2005 |
| KR | 20060097645 | 10/2007 |
| KR | 1020080112314 | 12/2008 |
| WO | WO-03/072247 | 9/2003 |

OTHER PUBLICATIONS

Chen et al., "Synthesis of Spherical FePd and CoPt Nanoparticles," J. Appl. Phys., vol. 91, No. pp. 8477-8479, (May 15, 2002).
Final Office Action received for U.S. Appl. No. 12/199,358 dated Nov. 8, 2011.
Hyeon et al., "Synthesis of Highly Crystalline and Monodisperse Maghemite Nanocrystallites Without a Size-Selection Process," J. Am. Chem. Soc., vol. 123, pp. 12798-12801, (2001).
Li et al., "Uniform Colloidal Spheres for (Y1-x Gdx)2O3 (x=0-1): Formation Mechanism, Compositional Impacts, and Physiochemical Properties of the Oxides," Chem. Mater, vol. 20, pp. 2274-2281, (2008).
Non-final Office Action received for U.S. Appl. No. 12/199,358 dated Jul. 22, 2011.
Notice of Allowance received for U.S. Appl. No. 12/199,358 dated Jan. 20, 2012.
Office Action Issued for Korean Patent Appl. No. 10-2008-0111733 mailed Dec. 20, 2010 (with English translation).
Park et al., "Monodisperse Nanoparticles of Ni and NiO: Synthesis, Characterization, Self-Assembled Superlattices, and Catalytic Applications in the Suzuki Coupling Reaction," Adv. Mater, vol. 17, No. 4, pp. 429-434, (2005).
SciFinder, History Search, accessed Nov. 4, 2011, URL: https://scifinder.cas.org, 3 pages.
Seo et al., "Size-Dependent Magnetic Properties of Colloidal Mn3O4 and MnO Nanoparticles," Angew Chem. Int. Ed., vol. 43, pp. 1115-117, (2004).
Sousa et al, "New Electric Double-Layered Magnetic Fluids Based on Copper, Nickel, and Zinc Ferrite Nanostructures," J. Phys. Chem. B, vol. 105, pp. 1168-1175, (2001).
Sun et al., "Monodisperse FePt Nanoparticles and Ferromagnetic FePt Nanocrystal Superlattices," Science, vol. 287, pp. 1989-1992, (Mar. 17, 2000).
Sun et al., "Monodisperse MFe2O4 (M=Fe, Co, Mn) Nanoparticles," J.Am. Chem. Soc., vol. 126, No. 1, pp. 273-279, (2004).
Sun et al., "Synthesis of Monodisperse Cobalt Nanocrystals and Their Assembly into Magnetic Superlattices (invited)," J. Appl. Phys., vol. 85, No. 8, pp. 4325-4330, (Apr. 15, 1999).
Yoon et al., "Magnetic Nanoparticles as a Catalyst Vehicle for Simple and Easy Recycling," New J. Chem., vol. 27, pp. 227-229, (2003).
Yoon et al., "Rh-based Olefin Hydroformylation Catalysts and the Change of Their Catalytic Activity Depending on the Size of Immobilizing Supporters," Inorganica Chimica Acta, vol. 345, pp. 228-234, (2003).

*Primary Examiner* — Melvin C Mayes
*Assistant Examiner* — Yun Qian
(74) *Attorney, Agent, or Firm* — Foley & Lardner LLP

(57) ABSTRACT

A magnetic nanoparticle complex includes a magnetic nanoparticle; and a ligand associated with the magnetic nanoparticle, the ligand including a functional group capable of combining with an acid component or a conjugate base of the acid component, in an oil. A method for preparing a magnetic nanoparticle complex, includes preparing a pre-ligand having at least one amino group and at least one carbamate group or dithiocarbamate group; associating the pre-ligand with a magnetic nanoparticle to form a magnetic nanoparticle-ligand complex; and modifying the ligand to form a modified ligand having a functional group capable of combining with an acid component in an oil or a conjugate base of the acid component.

5 Claims, No Drawings

MAGNETIC NANOPARTICLE COMPLEX

CROSS-REFERENCE TO RELATED APPLICATIONS

This application is a Divisional application of U.S. patent application Ser. No. 12/199,358, filed on Aug. 27, 2008, the entire disclosures of which is each hereby incorporated by reference for all purposes in its entirety as if fully set forth herein.

BACKGROUND

Oil typically includes acid components as impurities. The acids are both naturally occurring in oil and are generated as the result of chemical reactions, such as oxidation. The acid components can cause deterioration of oil, odors, and corrosion of equipment used at the site of pumping, refining, transfer, and storage. One such deleterious acid is naphthenic acid, and methods of reducing naphthenic acid have been proposed. For example, U.S. Pat. No. 5,182,013 discloses a method for diluting an oil including a large amount of naphthenic acid with an oil having a relatively small amount of naphthenic acid. U.S. Pat. No. 4,199,440 discloses treating liquid hydrocarbons with a dilute basic solution including sodium hydroxide, or the like.

SUMMARY

In one aspect, a magnetic nanoparticle complex includes a magnetic nanoparticle; and a ligand associated with the magnetic nanoparticle, the ligand including a functional group capable of combining with an acid component or a conjugate base of the acid component, in an oil. In some embodiments, the functional group includes an ammonium group capable of combining with the conjugate base of the acid component. In some embodiments, a nitrogen atom of the ammonium group is bound with at least one hydrocarbon group. In some embodiments, the hydrocarbon group includes $C_8$-$C_{20}$. In some embodiments, the functional group is bound with an anion which can be substituted by the conjugate base of the acid component. In some embodiments, the anion is a hydroxide ion.

In some embodiments, the ligand includes at least one carbamate group or at least one dithiocarbamate group. In some embodiments, the ligand includes both of following structural units:

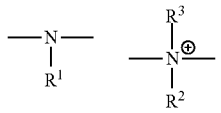

where $NR^1$, forms a carbamate group ($NC(O)O^-$) or a dithiocarbamate ($NC(S)S^-$) group, and $R^2$ and $R^3$ are each independently a hydrogen, alkyl, cycloalkyl, alkenyl, alkynyl, aryl, or aralkyl group, with the proviso that that $R^2$ and $R^3$ are not hydrogen concurrently, and at least one of $R^2$ and $R^3$ is a $C_8$-$C_{20}$ hydrocarbon group. In other embodiments, the ligand is derived from a compound of Formula I:

Formula I

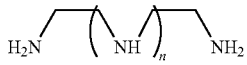

where n is an integer from 0 to 50. In some embodiments, at least some of hydrogen atoms in the secondary amino groups in the compound of Formula I are substituted by an aminoalkyl group, an aminocycloalkyl group, or an aminoaryl group. In such embodiments, n is greater than 0, for example from 1 to 50.

In another aspect, a method for preparing a magnetic nanoparticle complex is provided, including: preparing a pre-ligand including at least one amino group and at least one carbamate group or dithiocarbamate group; associating the pre-ligand with a magnetic nanoparticle; and modifying the pre-ligand associated with the magnetic nanoparticle to form a ligand including a functional group capable of combining with an acid component in an oil or a conjugate base of the acid component. In some embodiments, the functional group includes an ammonium group. In some embodiments, modifying the pre-ligand includes combining at least one hydrocarbon group with at least one amino group included in the pre-ligand to convert the amino group into an ammonium group. In some embodiments, the hydrocarbon group is a substituted or unsubstituted $C_8$-$C_{20}$ alkyl, cycloalkyl, alkenyl, alkynyl, aryl, or aralkyl group.

In some embodiments, the method further includes treating the pre-ligand with a basic solution including a hydroxide ion after combining at least one hydrocarbon group with at least one amino group. In some embodiments, the ligand includes both of following structural units:

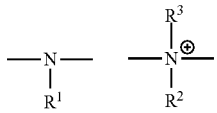

where $NR^1$, forms a carbamate group ($NC(O)O^-$) or a dithiocarbamate ($NC(S)S^-$) group, and $R^2$ and $R^3$ are each independently a hydrogen, alkyl, cycloalkyl, alkenyl, alkynyl, aryl, or aralkyl group, with the proviso that that $R^2$ and $R^3$ are not hydrogen concurrently, and at least one of $R^2$ and $R^3$ is a $C_8$-$C_{20}$ hydrocarbon group. In other embodiments, the ligand is derived from a compound of Formula I:

Formula I

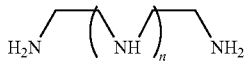

wherein n is an integer from 0 to 50. In some embodiments, at least some of hydrogen atoms in the secondary amino groups in the compound of Formula I are substituted by an aminoalkyl group, an aminocycloalkyl group, or an aminoaryl group. In such embodiments, n is greater than 0, for example from 1 to 50.

In another aspect, a method for refining an oil is provided including treating the oil with a magnetic nanoparticle complex to reduce an amount of an acid component in the oil. In some embodiments, the oil is petroleum. In some embodiments, the acid component includes naphthenic acid. In some embodiments, the method further includes separating the magnetic nanoparticle complex combined with the acid component or the conjugate base of the acid component by applying a magnetic field to a mixture of the oil and the magnetic nanoparticle complex. In some embodiments, the method further includes regenerating the magnetic nanoparticle complex combined with the acid component or the conjugate base of the acid component.

In some embodiments, regenerating the magnetic nanoparticle complex includes treating the magnetic nanoparticle complex combined with the acid component or the conjugate base of the acid component with an excess amount of a base component. In some embodiments, the base component includes a metal hydroxide or an ammonium hydroxide. In some embodiments, the method is performed by a continuous process.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

In one aspect, a magnetic nanoparticle complex is provided in which the complex includes a magnetic nanoparticle and a ligand. The ligand is functionalized with at least one group that is capable of combining with an acid or a conjugate base of the acid component, in an oil.

As used herein, "magnetic nanoparticle" refers to a magnetic nano-scaled particulate, and it may have a size of about 1-100 nm considering the dispersability, but it is not limited thereto. In some embodiments, the particular magnetic nanoparticle is not specifically limited, and a magnetic nanoparticle commonly known to skilled persons in the art may be used. For example, Co nanoparticles [*J. Appl. Phys.* 1999, 85, 4325.], FePt Alloy nanoparticles [*Science* 2000, 287, 1989], $\gamma$-$Fe_2O_3$ nanoparticles [*J. Am. Chem. Soc.* 2001, 123, 12798.], Ferrite nanoparticles, $MFe_2O_4$ (M=Fe, Co, Mn) [*J. Phys. Chem. B* 2001, 105, 1168.; *J. Am. Chem. Soc.* 2004, 126, 273.], FePd and CoPd nanoparticles [*J. Appl. Phys.* 2002, 91, 8477.], $Mn_3O_4$ and MnO nanoparticles [*Angew. Chem. Int. Ed* 2004, 43, 1115.], Ni nanoparticles [*Adv. Mater.* 2005, 17, 429.], $(Y_{1-x}Gd_x)_2O_3$ nanoparticles, wherein x is from 0 to 1, [*Chem. Mater.* 2008, 20, 2274.], or the like, may be used, but the magnetic nanoparticle is not limited thereto. Further, commercially available magnetic nanoparticles may be obtained such as Iron55-nickel45 alloy nanopowder (<100 nm) available from Aldrich, Iron nickel oxide 98% nanopowder $Fe_2NiO_4$ 20-30 nm available from Aldrich, iron oxide $Fe_3O_4$ nanopowder >98% 20-30 nm available from Merck, nickel cobalt oxide nanopowder 99% NiO CoO<30 nm available from Aldrich, cobalt (II III) oxide nanopowder 99.8% 20-30 nm available from Merck, nickel(II) oxide nanopowder 99.8% 10-20 nm available from Merck, gadolinium (III) oxide nanopowder 99.9+%<40 nm available from Aldrich, nickel zinc iron oxide nanopowder 99% available from Aldrich, copper zinc iron oxide nanopowder, <80 nm, 98.5% available from Aldrich, copper iron oxide nanopowder 98.5% available from Aldrich, or the like, but it is not limited thereto.

The ligand may be associated with the magnetic nanoparticle. Here, the meaning of the "association" may refer to not only various chemical bonds, such as coordinate covalent bond, ion bond, or covalent bond, but also physical bonds. For example, the ligand may be associated with a surface of the magnetic nanoparticle or an inside of the nanoparticle.

The ligand may include at least one functional group capable of combining with an acid component in the oil or a conjugate base of the acid component. In some embodiments, the term "oil" is not specifically limited, as long as the oil is classified in an oily state according to the general classification method. Further, the oil may include any type capable of existing in the oily state at any temperature, such as room temperature or a lower or higher temperature than room temperature, or by means of cooling or heating. Further, the oil is not limited to its usage. For example, oil for food or oil for industry may be used. Also, the oil may include crude oil or a petroleum product refined from crude oil.

The "acid component" in the oil may refer to various organic acids or inorganic acids included in the oil. The definition of "conjugate base" of the acid component is commonly known to skilled persons in the art, and it is named from Brönsted & Lowry's acid-base definition. For example, if the acid component is carboxylic acid (—COOH), its conjugate base is a carboxylate group ($—COO^-$).

In some embodiments, the functional group capable of combining with the acid component in the oil or the conjugate base of the acid component in the ligand may be an ammonium group, that is, in the form of an ammonium ion. Here, "ammonium group" or "the form of an ammonium ion" is not specifically related with the number of a substituent other than hydrogen. It may include any form of primary, secondary, tertiary, or quaternary ammonium ions.

In the ammonium group, the nitrogen atom may be bound with at least one hydrocarbon group. The hydrocarbon group may further improve the dispersability of the magnetic nanoparticle complex and prevent the aggregation between the magnetic nanoparticle complexes. The hydrocarbon group may include, but is not limited to $C_8$-$C_{20}$ considering the dispersability and aggregation of the magnetic nanoparticle complex in the oil. For example, the hydrocarbon group may be an aliphatic hydrocarbon group or aromatic hydrocarbon group, such as alkyl, cycloalkyl, alkenyl, alkynyl, aryl, aralkyl, or the like, but it is not limited thereto.

The functional group included in the magnetic nanoparticle complex may be bound with an anion capable of being substituted with the conjugate base of the acid component in the oil in case of contact with the acid component or the conjugate base of the acid component. For example, the anion may be a hydroxide ion, but is not limited thereto. Where the anion is the hydroxide ion and is substituted with the conjugate base of the acid component, water may be generated as a result of the substitution.

In some embodiments, the functional group is an ammonium group capable of combining with the conjugate base of the acid component. A nitrogen atom of the ammonium group may be bound with at least one hydrocarbon group. That is, in addition to the moiety binding the ammonium group to the ligand, the ammonium group has at least one additional hydrocarbon moiety attached. The hydrocarbon group may include, but is not limited to $C_8$-$C_{20}$. The functional group, i.e. the ammonium group, may be associated with an anion which may be substituted by the conjugate base of the acid component in the oil. The anion may include, but is not limited to a hydroxide ion. The ligand may also include, at least one carbamate, or dithiocarbamate group.

The ligand may include one or more of each of following structural units:

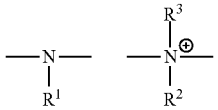

where $NR^1$, forms a carbamate group ($NC(O)O^-$) or a dithiocarbamate ($NC(S)S^-$) group, and $R^2$ and $R^3$ are each independently a hydrogen, alkyl, cycloalkyl, alkenyl, alkynyl, aryl, or aralkyl group, with the proviso that that $R^2$ and $R^3$ are not hydrogen concurrently, and at least one of $R^2$ and $R^3$ is a $C_8$-$C_{20}$ hydrocarbon group.

The ligand may be derived from a compound of Formula I:

Formula I

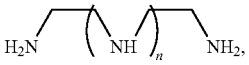

where n is an integer from 0 to 50. In some embodiments, at least a part of hydrogen atom in the secondary amino groups in the Chemical Formula I may be replaced by a substituent. In such embodiments, n is greater than 0, for example from 1 to 50. The substituent may be aminoalkyl group, an aminocycloalkyl group, or an aminoaryl group, but not limited thereto. When the substituent is bound to the secondary amino groups in the Chemical Formula I, the secondary amino group may be converted to a tertiary amino group. The substituent includes, but is not limited to C-C $_{50}$.

In some embodiments, a method for preparing a magnetic nanoparticle complex includes preparing a pre-ligand including at least one amino group and at least one carbamate group or dithiocarbamate group, associating the pre-ligand with a magnetic nanoparticle, and modifying the pre-ligand associated with the magnetic nanoparticle to form a ligand including a functional group capable of combining with an acid component in an oil or a conjugate base of the acid component.

The functional group may include, but is not limited to an ammonium group. The pre-ligand may be modified by combining at least one hydrocarbon group with at least one amino group included in the pre-ligand to convert the amino group into an ammonium group. The hydrocarbon group may include, substituted or unsubstituted alkyl, cycloalkyl, alkenyl, alkynyl, aryl, or aralkyl group having $C_8$-$C_{20}$.

In some embodiments, the method further includes treating the pre-ligand with a basic solution including a hydroxide ion after combining at least one hydrocarbon group with at least one amino group. Here, the basic solution may include a metal hydroxide or ammonium hydroxide serving as the compound including a hydroxide ion, but it is not limited thereto. For example, a metal in the metal hydroxide is an alkali metal or alkaline earth metal, such as Li, Na, K, Ca, Mg, or the like, but not limited thereto. An ammonium group in the ammonium hydroxide may be $NH_4^+$, primary, secondary, tertiary or quartenary ammonium depending on the number of hydrocarbon groups attached on the nitrogen. The ligand may include, but is not limited to at least one of each of the following structural units

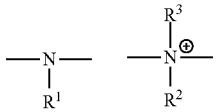

where $NR^1$, forms a carbamate group ($NC(O)O^-$) or a dithiocarbamate ($NC(S)S^-$) group, and $R^2$ and $R^3$ are each independently hydrogen, alkyl, cycloalkyl, alkenyl, alkynyl, aryl, or aralkyl group, with the proviso that $R^2$ and $R^3$ are not hydrogen concurrently, and at least one of $R^2$ and $R^3$ is a $C_8$-$C_{20}$ hydrocarbon group.

The ligand may be derived from a compound of Formula I:

Formula I

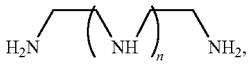

where n is an integer from 0 to 50. In some embodiments, at least a part of hydrogen atom in the secondary amino groups in the Chemical Formula I may be replaced by a substituent. In such embodiments, n is greater than 0, for example from 1 to 50. The substituent may be aminoalkyl group, an aminocycloalkyl group, or an aminoaryl group, but not limited thereto. When the substituent is bound to the secondary amino groups in the Chemical Formula I, the secondary amino group may be converted to a tertiary amino group. The substituent includes, but is not limited to $C_1$-$C_{50}$.

In some embodiments, a method for refining an oil includes treating the oil with a magnetic nanoparticle complex. The oil may include, but is not limited to petroleum. The acid component may include, but is not limited to naphthenic acid.

In some embodiments, the method further includes separating the magnetic nanoparticle complex combined with the acid component or a conjugate base of the acid component by applying a magnetic field to a mixture of the oil and magnetic nanoparticle complex. In some embodiments, the method further includes regenerating the magnetic nanoparticle complex combined with the acid component or a conjugate base of the acid component. In some embodiments, the magnetic nanoparticle complex is regenerated by treating the magnetic nanoparticle complex combined with the acid component or the conjugate base of the acid component with an excess amount of a base component. The base component may include, but is not limited to a metal hydroxide or an ammonium hydroxide. For example, a metal in the metal hydroxide is an alkali metal or alkaline earth metal, such as Li, Na, K, Ca, Mg, or the like, but not limited thereto. An ammonium group in the ammonium hydroxide may be $NH_4^+$, primary, secondary, tertiary or quartenary ammonium depending on the number of hydrocarbon groups attached on the nitrogen. The method may be performed by a continuous process. In some embodiments, the magnetic nanoparticle complex may be used for effectively removing the acid component in an oil. By appropriately modifying the ligand, the magnetic nanoparticle complex may be dispersed in the oil in a quasi-homogeneous manner. Herein, "quasi-homogeneous" means that the magnetic nanoparticle complex is dispersed homogeneously in the oil, although the magnetic nanoparticle complex may not be dissolved in the oil. Thus, the dispersability with respect to the oil may be further improved. Further, the magnetic nanoparticle complex can facilitate facile separation and regeneration of the complex after removing the acid from the oil.

Methods for preparing magnetic nanoparticle complexes include preparing a pre-ligand including at least one amino group and at least one carbamate group or dithiocarbamate group, associating the pre-ligand with a magnetic nanoparticle, and modifying the pre-ligand associated with the magnetic nanoparticle complex to form a ligand including a functional group capable of combining with an acid component in an oil or a conjugate base of the acid component.

PROPHETIC EXAMPLE 1

A pre-ligand including at least one amino group and at least one carbamate group or dithiocarbamate group is prepared. As used herein, "pre-ligand" refers to a ligand compound used for forming a final ligand included in the magnetic nanoparticle complex. There is not specific limitation to the kind of the pre-ligand as long as the pre-ligand includes at least one amino group and at least one carbamate or dithiocarbamate group. The carbamate group and dithiocarbamate group are the functional groups enabling the ligand to be associated with the magnetic nanoparticle. In some embodiments, the pre-ligand is formed through reacting the compound Formula I with $CS_2$ or $CO_2$.

Formula I

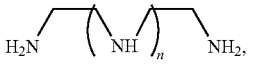

wherein n is an integer from 0 to 50.

As described above, at least a part of the hydrogen atoms in the secondary amino groups in the compound of Formula I may be replaced by a substituent. In such embodiments, n is greater than 0, for example from 1 to 50. The substituent may be an aminoalkyl group, an aminocycloalkyl group, or an aminoaryl group, but it is not limited thereto. When the substituent is bound to the secondary amino groups in the compound of Formula I, the secondary amino group may be converted to a tertiary amino group. The substituent may has $C_1$-$C_{50}$, but not limited thereto.

For example, the compound of Formula I in forming the pre-ligand includes linear or branched ethylenediamine, diethylenetriamine, diethylenepentamine, polyethyleneimine, and the like, and also mixtures of the amines.

The secondary amine groups in the compound of Formula I are more amenable to nucleophilic substitution reactions that the primary amines (—$NH_2$) positioned at an ends of the compound of Formula I. In some embodiments, the compound of Formula I is reacted with $CS_2$, $CO_2$, or the like, to prepare the pre-ligand, and the carbamate group or dithiocarbamate group may be selectively formed in a portion of the secondary amine groups by adjusting the quantity of the $CS_2$ or $CO_2$.

Subsequently, the pre-ligand is associated with the magnetic nanoparticle. The magnetic nanoparticle as described above may be the free particle or the particle may have an organic acid ligand, such as stearic or oleic acid. The pre-ligand may be associated with the magnetic nanoparticle by a method known to skilled persons in the art.

The pre-ligand associated with the magnetic nanoparticle may then be modified. Through the modification, a ligand including a functional group may be formed. The ligand may combine with the acid component in the oil or the conjugate base of the acid component. Here, the functional group capable of combining with the acid component in the oil or the conjugate base of the acid component may be in the form of the ammonium group, but it is not limited thereto.

Further, the pre-ligand may be modified by binding at least one hydrocarbon group with at least one amino group included in the pre-ligand to convert the amino group into the ammonium group.

In some embodiments, the amino group is reacted with a hydrocarbon halide compound so that the hydrocarbon group is then transferred to the nitrogen atom of the amino group. In some embodiments, the halide compound is represented as RX, where, R is a hydrocarbon group and X is a halogen. The hydrocarbon group may include $C_8$-$C_{20}$ considering the dispersability and aggregation of the formed magnetic nanoparticle complex in the oil, but it is not limited thereto. In some embodiments, the hydrocarbon is alkyl, cycloalkyl, alkenyl, alkynyl, aryl, or aralkyl.

Further, after combining at least one hydrocarbon group with at least one amino group, the method for preparing the magnetic nanoparticle complex may further include treating the resultant product with a basic solution including a hydroxide ion. Here, the basic solution may include a metal hydroxide or ammonium hydroxide serving as the compound including a hydroxide ion, but it is not limited thereto. For example, a metal in the metal hydroxide is an alkali metal or alkaline earth metal, such as Li, Na, K, Ca, Mg, or the like, but not limited thereto. An ammonium group in the ammonium hydroxide may be $NH_4^+$, primary, secondary, tertiary or quartenary ammonium depending on the number of hydrocarbon groups attached on the nitrogen.

Through the above process, the hydroxide ion included in the basic solution may be substituted with the anion of the element of the halogen group bound with the ammonium ion formed in the reaction of binding the hydrocarbon group to the amino group. That is, the hydroxide ion may be bound with the ammonium ion bound with the hydrocarbon group through the above process.

In some embodiments, the acid component in the oil may be removed using the magnetic nanoparticle complex. For example, the magnetic nanoparticle complex after treatment may be separated from the oil by a continuous process without breaking a series of processes. The separation process may employ a magnetic decantation method.

In some embodiments, the method for refining the oil may further include regenerating the magnetic nanoparticle complex combined with the acid component or the conjugate base of the acid component. The magnetic nanoparticle complex may be regenerated by treating the magnetic nanoparticle complex combined with the acid component or the conjugate base of the acid component with the excess amount of the base component. Here, the base component may include a metal hydroxide or ammonium hydroxide serving as the compound including a hydroxide ion, but it is not limited thereto. For example, a metal in the metal hydroxide is an alkali metal or alkaline earth metal, such as Li, Na, K, Ca, Mg, or the like, but not limited thereto. An ammonium group in the ammonium hydroxide may be $NH_4^+$, primary, secondary, tertiary or quartenary ammonium depending on the number of hydrocarbon groups attached on the nitrogen.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The embodiments, illustratively described herein may suitably be practiced in the absence of any element or elements, limitation or limitations, not specifically disclosed herein.

Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed invention. Additionally the phrase "consisting essentially of" will be understood to include those elements specifically recited and those additional elements that do not materially affect the basic and novel characteristics of the claimed invention. The phrase "consisting of" excludes any element not specifically specified.

In general, "substituted" refers to a group, as defined below (e.g., an alkyl or aryl group) in which one or more bonds to a hydrogen atom contained therein are replaced by a bond to non-hydrogen or non-carbon atoms. Substituted groups also include groups in which one or more bonds to a carbon(s) or hydrogen(s) atom are replaced by one or more bonds, including double or triple bonds, to a heteroatom. Thus, a substituted group will be substituted with one or more substituents, unless otherwise specified. In some embodiments, a substituted group is substituted with 1, 2, 3, 4, 5, or 6 substituents. Examples of substituent groups include: halogens (i.e., F, Cl, Br, and I); hydroxyls; alkoxy, alkenoxy, alkynoxy, aryloxy, aralkyloxy, heterocyclyloxy, and heterocyclylalkoxy groups; carbonyls(oxo); carboxyls; esters; urethanes; oximes; hydroxylamines; alkoxyamines; aralkoxyamines; thiols; sulfides; sulfoxides; sulfones; sulfonyls; sulfonamides; amines; N-oxides; hydrazines; hydrazides; hydrazones; azides; amides; ureas; amidines; guanidines; enamines; imides; isocyanates; isothiocyanates; cyanates; thiocyanates; imines; nitro groups; nitriles (i.e., CN); and the like.

Alkyl groups include straight chain and branched alkyl groups having from 1 to 20 carbon atoms or, in some embodiments, from 1 to 12, 1 to 8, 1 to 6, or 1 to 4 carbon atoms. Alkyl groups further include cycloalkyl groups. Examples of straight chain alkyl groups include those with from 1 to 8 carbon atoms such as methyl, ethyl, n-propyl, n-butyl, n-pentyl, n-hexyl, n-heptyl, and n-octyl groups. Examples of branched alkyl groups include, but are not limited to, isopropyl, iso-butyl, sec-butyl, tert-butyl, neopentyl, isopentyl, and 2,2-dimethylpropyl groups. Representative substituted alkyl groups may be substituted one or more times with substituents such as those listed above. Where the term haloalkyl is used, the alkyl group is substituted with one or more halogen atoms.

Alkenyl groups include straight and branched chain and cycloalkyl groups as defined above, except that at least one double bond exists between two carbon atoms. Thus, alkenyl groups have from 2 to about 20 carbon atoms, and typically from 2 to 12 carbons or, in some embodiments, from 2 to 8, 2 to 6, or 2 to 4 carbon atoms. In some embodiments, alkenyl groups include cycloalkenyl groups having from 4 to 20 carbon atoms, 5 to 20 carbon atoms, 5 to 10 carbon atoms, or even 5, 6, 7, or 8 carbon atoms. Examples include, but are not limited to vinyl, allyl, $—CH{=}CH(CH_3)$, $—CH{=}C(CH_3)_2$, $C(CH_3){=}CH_2$, $—C(CH_3){=}CH(CH_3)$, $—C(CH_2CH_3){=}CH_2$, cyclohexenyl, cyclopentenyl, cyclohexadienyl, butadienyl, pentadienyl, and hexadienyl, among others. Representative substituted alkenyl groups may be mono-substituted or substituted more than once, such as, but not limited to, mono-, di- or tri-substituted with substituents such as those listed above.

Aryl groups are cyclic aromatic hydrocarbons that do not contain heteroatoms. Aryl groups include monocyclic, bicyclic and polycyclic ring systems. Thus, aryl groups include, but are not limited to, phenyl, azulenyl, heptalenyl, biphenylenyl, indacenyl, fluorenyl, phenanthrenyl, triphenylenyl, pyrenyl, naphthacenyl, chrysenyl, biphenyl, anthracenyl, indenyl, indanyl, pentalenyl, and naphthyl groups. In some embodiments, aryl groups contain 6-14 carbons, and in others from 6 to 12 or even 6-10 carbon atoms in the ring portions of the groups. Although the phrase "aryl groups" includes groups containing fused rings, such as fused aromatic-aliphatic ring systems (e.g., indanyl, tetrahydronaphthyl, and the like), it does not include aryl groups that have other groups, such as alkyl or halo groups, bonded to one of the ring members. Rather, groups such as tolyl are referred to as substituted aryl groups. Representative substituted aryl groups may be mono-substituted or substituted more than once. For example, monosubstituted aryl groups include, but are not limited to, 2-, 3-, 4-, 5-, or 6-substituted phenyl or naphthyl groups, which may be substituted with substituents such as those listed above.

As used herein, "halogen" refers to F, Cl, Br, or I.

As used herein, ammonium, or quaternary amine, refers to groups or ions having the following structure, $^{+}NR^{a}R^{b}R^{c}R^{d}$, where $R^{a}$, $R^{b}$, $R^{c}$, and $R^{d}$ are independently selected from H, alkyl, cycloalkyl, alkenyl, alkynyl, aryl, and aralkyl groups. Thus, all of the $R^{a-d}$ groups may be the same or different. Alkyl ammonium refers to ammonium groups having one, two, three, or four alkyl groups, while tetralkylammonium refers to ammonium groups having four alkyl groups. Mixed alkyl ammoniums are those ammonium having two, three, or four alkyl groups where at least one of the alkyl groups is different from the other alkyl groups.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

The present embodiments, thus generally described, will be understood more readily by reference to the following examples, which are provided by way of illustration and are not intended to be limiting of the present technology in any way.

EXAMPLES

The present technology is further illustrated by the following examples, which should not be construed as limiting in any way.

Comparative Example 1

Preparing a Ligand Based on Diethylenetriamine

Diethylenetriamine (0.5 g, 4.8 mmol) is added to an NaOH (1.72 g, 44 mmol) solution in a mixed solvent (ethanol/water=50 mL/10 mL) at a room temperature. $CS_2$ (9.07 ml, 0.12 mol) is separately dissolved in ethanol (10 mL) and then is slowly added to the mixed solution. After two hours, the reaction mixture is dried under vacuum to obtain a light yellow-colored solid product. The solid product is identified as the product in which all amino groups including the end amino group are converted into dithiocarbamate groups ($^{1}H$ NMR (ppm, in $D_2O$): 4.34 (t, 4H), 3.91 (t, 4H)).

Example 1

Preparing a Pre-Ligand Based on Diethylenetriamine

Diethylenetriamine (0.2 g, 2 mmol) is dissolved in ethanol (40-50 ml) at 0° C., and $CS_2$ (0.15 ml, 2 mmol) in ethanol (10 ml) is slowly added to the solution. The mixed solution is stirred for 10 minutes at 0° C., filtered, and a white precipitate is collected and washed with ethanol several times. ($^1$H NMR (ppm, in $D_2O$): 4.31 (t, 4H), 3.24 (t, 4H)).

Example 2

Preparing a Pre-Ligand Based on Tetraethylenepentamine

Tetraethylenepentamine (0.37 g, 2 mmol) is dissolved in ethanol (40-50 ml) at 0° C., and $CS_2$ (0.3 ml, 4 mmol) in ethanol (10 ml) is slowly added to the solution. The mixed solution is stirred for 10 minutes at 0° C., filtered, and a white precipitate is collected and washed with ethanol several times. ($^1$H NMR (ppm, in $D_2O$): 4.35-4.15 (b, —$CH_2$—$NCS_2^-$), 3.2-2.5 (b, —$CH_2$—NH— or —$CH_2$—$NH_2$—)).

Example 3

Preparing a Pre-Ligand Based on Polyethyleneimine

Polyethyleneimine (0.423 g, 1 mmol; Mn=423, CAS #29320-38-5, Aldrich) is dissolved in ethanol (40-50 ml) at 0° C., and $CS_2$ (0.38 nil, 5 mmol) in ethanol (10 ml) is slowly added to the solution. The mixed solution is stirred for 10 minutes at 0° C., filtered, and a white precipitate is collected and washed with ethanol several times. ($^1$H NMR (ppm, in $D_2O$): 4.35-4.15 (b, —$CH_2$—$NCS_2^-$), 3.2-2.5 (b, —$CH_2$—NH— or —$CH_2$—$NH_2$—)).

Example 4

Preparation of Magnetic Nanoparticle Complex

The pre-ligand prepared in the preparation Example 2 is used. The pre-ligand (100 mg) is dissolved in THF (2 ml) together with tetrabutylammonium hydroxide (400 mg, 1.5 mmol). A $\gamma$-$Fe_2O_3$ magnetic nanoparticle (2 mg, synthesized by the method disclosed by Hyeon, T et al. *J. Am. Chem. Soc.* 2001, 123, 12798-12801) in THF (2 mL) is added to the solution. The mixture is centrifuged four times for 10 minutes at 15,000 rpm.

The obtained magnetic nanoparticle with the ligand may be dispersed in water. Subsequently, an excess amount of octyl bromide (0.87 g, 4.5 mmol) is added to the obtained magnetic nanoparticle at 25° C. and stirred for 10 hours. Through the process, the pre-ligand associated on the surface of the magnetic nanoparticle may be modified and at least one secondary and/or primary amine group(s) of the ligand is transformed to an ammonium ion group having an octyl moiety. The bromide anion from the octyl bromide is, at least initially, associated with the ammonium ion. Subsequently, metathesis of the bromide for hydroxide ion is conducted by treating the complex with a dilute NaOH solution.

Examples 5 and 6

Preparation of Magnetic Nanoparticle Complex

Magnetic nanoparticles are prepared as shown in Example 4, except that the pre-ligands prepare in Examples 1 and 3 are used in place of the pre-land from Example 2.

Example 7

Refining an Oil

The magnetic nanoparticle complex prepared in Example 4 is introduced in the refining process of a crude oil containing naphthenic acid. The ammonium groups of the magnetic nanoparticle complex then associate with the naphthenic acid in the crude oil. Thereafter, the magnetic nanoparticle complex is separated from the crude oil by application of a magnetic field. The separated magnetic nanoparticle complex is treated with a solution of an alkylammonium hydroxide, such as tetrabutylammonium hydroxide, in an organic solvent, to separate the naphthenic acid. After removal of the naphthenic acid, the magnetic nanoparticle complex is regenerated.

Equivalents

The present disclosure is not to be limited in terms of the particular embodiments described in this application. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method for preparing a magnetic nanoparticle complex, comprising:

preparing a pre-ligand comprising:

at least one amino group; and at least one carbamate group or dithiocarbamate group;

associating the pre-ligand with a magnetic nanoparticle; and modifying the pre-ligand associated with the magnetic nanoparticle to form a ligand associated with the magnetic nanoparticle, the ligand comprising:

a functional group configured to combine with an acid component in an oil or a conjugate base of the acid component;

wherein:

the functional group comprises an amine group configured to combine with an acid component, or an ammonium group configured to combine with the conjugate base of the acid component;

a nitrogen atom of the ammonium group is bound with at least one hydrocarbon group;

the hydrocarbon group is a substituted or unsubstituted $C_8$-$C_{20}$ alkyl, cycloalkyl, alkenyl, alkynyl, aryl, or aralkyl group; and the ligand associated with the nanoparticle is a magnetic nanoparticle complex.

2. The method of claim 1, further comprising treating the pre-ligand with a basic solution including a hydroxide ion after contacting at least one hydrocarbon group with at least one amino group.

3. The method of claim 1, wherein:

the ligand comprises both of following structural units:

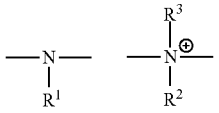

wherein:

$R^1$ is $C(O)O^-$ or $C(S)S^-$; and $R^2$ and $R^3$ are each independently a hydrogen, alkyl, cycloalkyl, alkenyl, alkynyl, aryl, or aralkyl group, with the proviso that $R^2$ and $R^3$ are not hydrogen concurrently, and at least one of $R^2$ and $R^3$ is a $C_8$-$C_{20}$ hydrocarbon group.

4. The method of claim 1, wherein preparing the pre-ligand comprises contacting a compound of Formula I:

Formula I

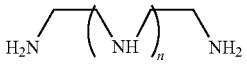

with $CS_2$ or $CO_2$;

wherein n is an integer from 0 to 50.

5. The method of claim 1, wherein:

preparing the pre-ligand comprises contacting $CS_2$ or $CO_2$ with a compound of Formula I:

Formula I

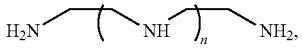

wherein at least some of hydrogen atoms in the secondary amino groups in the compound of Formula I are substituted by an aminoalkyl group, an aminocycloalkyl group, or an aminoaryl group; and n is an integer from 1 to 50.

* * * * *

UNITED STATES PATENT AND TRADEMARK OFFICE

CERTIFICATE OF CORRECTION

PATENT NO. : 8,366,916 B2
APPLICATION NO. : 13/404517
DATED : February 5, 2013
INVENTOR(S) : Lee It is certified that error appears in the above-identified patent and that said Letters Patent is hereby corrected as shown below:

On the Title Page, item (56), under "OTHER PUBLICATIONS", in Column 1, Line 2, delete "No." and insert -- No. 10, --, therefor.

On the Title Page, item (56), under "OTHER PUBLICATIONS", in Column 2, Line 5, delete "Physiochemical" and insert -- Physicochemical --, therefor.

On the Title Page, item (56), under "OTHER PUBLICATIONS", in Column 2, Line 23, delete "et al," and insert -- et al., --, therefor.

In the Specifications:

In Column 3, Line 53, delete "wherein" and insert -- where --, therefor.

In Column 5, Line 37, delete "C-$C_{50}$." and insert -- $C_1$-$C_{50}$. --, therefor.

In Column 5, Line 64, delete "quartenary ammonium" and insert -- quaternary ammonium --, therefor at each occurrence throughout the whole specification.

In Column 5, Line 67, delete "units" and insert -- units: --, therefor.

In Column 11, Line 30, delete "(0.38 nil," and insert -- (0.38 ml, --, therefor.

Signed and Sealed this
Eleventh Day of June, 2013

Teresa Stanek Rea
*Acting Director of the United States Patent and Trademark Office*